United States Patent [19]

Kubert et al.

[11] Patent Number: 5,077,172

[45] Date of Patent: Dec. 31, 1991

[54] CARRIER WEB TRANSFER DEVICE AND METHOD FOR ELECTROPHOTOGRAPHIC PRINTING PRESS

[75] Inventors: Vincent T. Kubert, Melbourne, Fla.; Paul V. Sadwick, Dayton, Ohio

[73] Assignee: AM International, Inc., Chicago, Ill.

[21] Appl. No.: 457,316

[22] Filed: Dec. 28, 1989

[51] Int. Cl.[5] ..... G03G 13/14

[52] U.S. Cl. ..... 430/117; 430/126; 118/647

[58] Field of Search ..... 430/117, 124, 126; 118/644, 647

[56] References Cited

U.S. PATENT DOCUMENTS

| | | | |
|---|---|---|---|
| 3,015,340 | 1/1962 | Montz et al. | 137/124 |
| 3,599,070 | 8/1971 | Davis et al. | 320/5 |
| 3,698,926 | 10/1972 | Furuichi | 117/17.5 |
| 3,736,103 | 5/1973 | Stibbe | 23/277 |
| 3,739,491 | 6/1973 | Creapo et al. | 34/156 |
| 3,776,440 | 12/1973 | Frost et al. | 226/97 |
| 3,873,013 | 3/1975 | Stibbe | 226/97 |
| 3,907,423 | 9/1975 | Hayashi et al. | 355/10 |
| 3,964,656 | 6/1976 | Hella | 226/97 |
| 4,021,586 | 5/1977 | Matkan | 427/17 |
| 4,052,959 | 10/1977 | Hayashi et al. | 118/644 |
| 4,116,620 | 9/1978 | Stibbe | 432/59 |
| 4,177,730 | 12/1979 | Schriber et al. | 101/248 |
| 4,182,472 | 1/1980 | Peekna | 226/97 |
| 4,197,971 | 4/1980 | Stibbe | 226/97 |
| 4,197,972 | 4/1980 | Daane | 226/97 |
| 4,197,973 | 4/1980 | Deane | 226/97 |
| 4,201,323 | 5/1980 | Stibbe et al. | 226/97 |
| 4,220,699 | 9/1980 | Ishida et al. | 430/126 |
| 4,265,384 | 5/1981 | Daane | 226/97 |
| 4,282,998 | 8/1981 | Peekna | 226/97 |
| 4,286,039 | 8/1981 | Landa et al. | 430/119 |
| 4,288,015 | 9/1981 | Curtin | 226/97 |
| 4,295,383 | 10/1981 | Frost | 474/83 |
| 4,310,238 | 1/1982 | Mochizuki et al. | 355/14 |
| 4,325,627 | 4/1982 | Suidler et al. | 355/10 |
| 4,343,769 | 8/1982 | Hentalmann | 422/109 |
| 4,369,584 | 1/1983 | Daane | 34/12 |
| 4,399,203 | 8/1983 | Bennett | 429/191 |
| 4,411,976 | 10/1983 | Landa et al. | 430/126 |
| 4,425,719 | 1/1984 | Klein et al. | 34/156 |
| 4,455,562 | 6/1984 | Dolan et al. | 346/154 |
| 4,462,169 | 7/1984 | Daane | 34/62 |
| 4,474,496 | 10/1984 | Rocheleau | 432/59 |
| 4,480,859 | 11/1984 | Rueckl et al. | 285/163 |
| 4,482,624 | 11/1984 | Arney et al. | 430/138 |
| 4,515,292 | 5/1985 | Koos, Jr. | 222/52 |
| 4,563,086 | 1/1986 | Knapp et al. | 355/14 |
| 4,601,259 | 7/1986 | Yamashita | 118/658 |
| 4,631,244 | 12/1986 | Mitchell | 430/137 |
| 4,702,985 | 10/1987 | Larson | 430/115 |
| 4,708,460 | 11/1987 | Langdon | 430/126 |
| 4,734,737 | 3/1988 | Koichi | 355/14 |
| 4,760,423 | 7/1988 | Holtje et al. | 355/3 |
| 4,827,315 | 5/1989 | Wolfberg et al. | 346/160 |
| 4,828,956 | 5/1989 | Creatura et al. | 430/137 |
| 4,829,336 | 5/1989 | Champion et al. | 355/246 |
| 4,848,633 | 7/1989 | Hagen et al. | 226/97 |
| 4,860,924 | 8/1989 | Simms et al. | 222/56 |

*Primary Examiner*—John Goodrow

*Attorney, Agent, or Firm*—Tarolli, Sundheim & Covell

[57] ABSTRACT

A transfer mechanism and method are provided for utilization in a high speed electrophotographic printing process of the type wherein the electrophotoconductive cylinder on which the image is formed travels at a peripheral speed of at least 100 ft./min. Transfer of the image is made to a continuous web of paper or the like travelling synchronously with the cylinder surface speed. A transfer corona focuses a narrow band of ions proximate the cylinder-web interface to attract at least 95% of the solids, toner particles from the cylinder to the travelling web. The charge on the transfer corona exceeds the charge on the image portions of the rotating cylinder by at least about 5,000 volts.

16 Claims, 3 Drawing Sheets

CARRIER WEB TRANSFER DEVICE AND METHOD FOR ELECTROPHOTOGRAPHIC PRINTING PRESS

FIELD OF THE INVENTION

The present invention pertains to a high speed electrophotographic printing press and specifically to methods and apparatus for transferring liquid toner dispersion material carried by the surface of the electrophotographic printing cylinder to a travelling web of paper or the like.

BACKGROUND OF THE INVENTION

Electrophotographic printing is well known and has been widely refined. For example, today, almost every office and indeed some homes have electrophotographic copiers. The industry has grown to the point where it is now a highly competitive multi-billion dollar industry. In most instances, these home and office copiers are capable of providing only about a few copies per minute.

In electrophotography, images are photoelectrically formed on a photoconductive layer mounted on a conductive base. Liquid or dry developer or toner mixtures may be used to develop the requisite image.

Liquid toner dispersions for use in the process are formed by dispersing dyes or pigments and natural or synthetic resin materials in a highly insulating, low dielectric constant carrier liquid. Charge control agents are added to the liquid toner dispersions to aid in charging the pigment and dye particles to the requisite polarity for proper image formation on the desired substrate.

The photoconductive layer is sensitized by electrical charging whereby electrical charges are uniformly distributed over the surface. The background area of the photoconductive layer is then exposed by projecting or alternatively by writing over the surface thereof with a laser, L.E.D., or the like. The electrical charges on the photoconductive layer are conducted away from the areas exposed to light with an electrostatic charge remaining in the image area. The charged pigment and/or dye particles from the liquid toner dispersion contact and adhere to the image areas of the photoconductive layer. The image is then transferred to the desired substrate, such as a travelling web of paper or the like.

In contrast to office and home copiers, high speed electrophotographic printing presses are being developed wherein successive images are rapidly formed on the photoconductive medium for rapid transfer to carrier sheets or the like travelling at speeds of greater than 100 ft./min. and even at speeds of from 300–500 ft./min. As can be readily understood, such high speed machines readily consume the solid pigment and/or dye and associated resin particles from the liquid toner baths.

As noted above, after the requisite image has been formed on the electrophotoconductive surface by the attraction of the color-imparting solids toner particles to the image portions of the latent electrostatic image, it is necessary to efficiently transfer that formed image to the desired substrate such as a travelling web of paper or similar article.

In order to prevent smearing and distortion of the image during the transfer process, it is necessary to ensure that the speed of the travelling web is precisely synchronized with the peripheral speed of the rotating electrophotoconductive cylinder during this transfer process. Moreover, so as to provide for high print quality character definition, it is necessary that the transfer process result in effective transfer of almost all of the color-imparting toner solids particles from the rotating electrophotoconductive surface to the travelling web.

These and other objects are met by the invention hereof that provides for efficient high speed transfer of the liquid toner dispersion travelling on the rotating electrophotoconductive cylinder to an adjacent, travelling web of paper or the like.

SUMMARY OF THE INVENTION

In accordance with the invention, a transfer mechanism and method are provided for utilization in a high speed electrophotographic printing process of the type adapted to operate at web speeds of 100 ft./min. and greater. More specifically, such high speed methods may operate at speeds of 300–500 ft./min.

After the requisite image has been formed on the rotating photoconductive print cylinder in such high speed processes, a travelling web of paper is caused to contact the cylinder along a narrow, rectangular area of contact at the cylinder-web interface. The paper web is synchronized with and driven at the same speed as the peripheral speed of the cylinder. In such manner, disturbance of the developed image on the cylinder surface during transfer is minimized and the size of the image produced on the web is controlled to prevent distortion.

A transfer corona focuses a narrow band of ions on the back of the paper creating a positive charge to overcome the print cylinder charge and attract the negatively charged solid, color-imparting toner particles and urge them to transfer to the web at the interface area. A shield helps to focus the ions proximate the interface.

The charge potential imparted to this interface by the transfer corona exceeds the charge on the image portions of the rotating cylinder by at least about 5,000 volts. Both the cylinder charge in the image area and the transfer charge are of positive polarity. Accordingly, a strong electrical field is formed in the direction of web to cylinder surface. The negatively charged, solids, color-imparting toner particles, electrostatically attracted to the image on the cylinder, migrate opposite to the electrical field direction and are transferred to the web. The toner carrier liquid also transfers to the travelling web mostly via physical contact and capillary attraction. Based upon preliminary data, transfer of the toner solids particles has been achieved in the range of about 95% or greater. That is, more than 95% of the solids transfer effectively to the travelling web. This factor is of extreme importance in light of the high speed nature of the printing process and the attendant demand for high print quality.

After image transfer to the travelling web, the web is forwarded to a dryer-fuser station to evaporate the volatile carrier liquid therefrom and to fuse the color, toner particles thereto. The web may then be passed to subsequent operations such as hole punching, perforating, etc. See, for instance, U.S. Pat. No. 4,177,730, of common assignment herewith, for a description of a variety of other processing units.

The invention will now be further described in conjunction with the appended drawing and the following detailed description.

Figure 1:
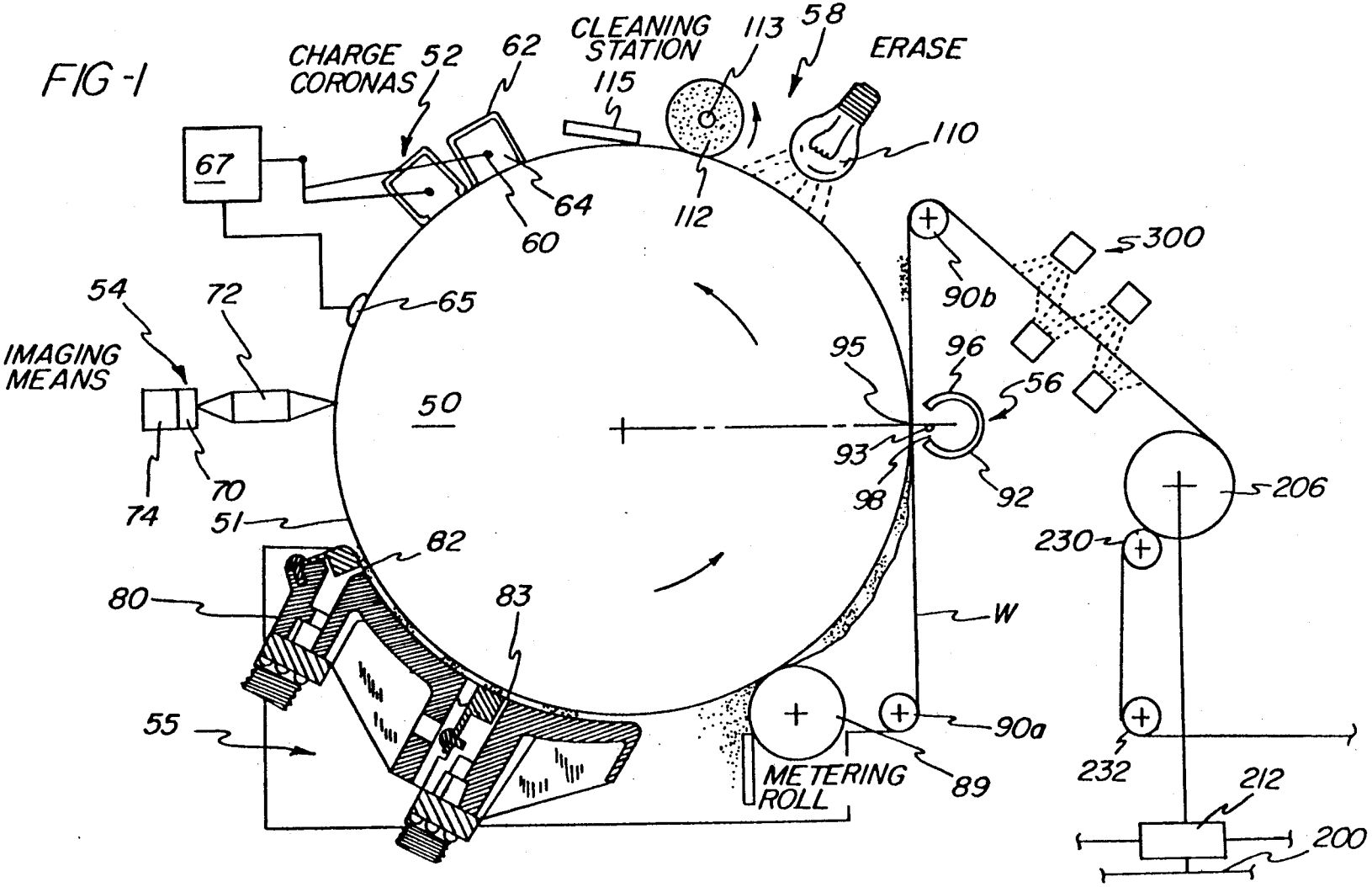
FIG. 1 is a schematic diagram showing the electrophotographic printing cylinder, associated operating stations and print transfer mechanism in accordance with the invention.

Turning to FIG. 1, this view shows the overall organization of a typical photoconductive cylinder and associated mechanisms for formation of the latent electrostatic image, and subsequent image formation on the cylinder surface. A rotatable photoconductive drum 50, typically SeTe, $As_2$,$Se_3$, or the like, rotates in a counterclockwise direction as indicated by the arrow shown on cylinder 50 in FIG. 1. Special systems are arranged sequentially around drum 50 as shown in FIG. 1, to accomplish the desired formation and transfer of images onto web w. These systems include a high intensity charging apparatus 52, exposing-discharging (or imaging) apparatus 54, developing apparatus 55, metering apparatus 89, transfer apparatus 56, erasing apparatus, and cleaning apparatus 58. These assure that the drum surface is charged, exposed, discharged, metered, erased, and cleared of residual toner, while the developed images are continually transferred to the web material w.

Charging apparatus 52 comprises a plurality of corona charge devices comprising corona charge wires 60 disposed within appropriately shaped shielded members 62 with each wire 60 and associated shield member 62 forming a separate focusing chamber 64. The charge imparted by the coronas to the photoconductive cylinder is on the order of at least +1000 volts d.c., preferably between +1000 and +1450 volts. These corona assemblies extend across the drum surface 51 and along an arc closely parallel to surface 51. In a successful embodiment using a drum having a 33-inch circumference (thus 10.504-inch diameter) the arcuate length of the charging unit is about 4.5 inches or somewhat greater than ⅛th of the drum circumference.

Proceeding counterclockwise around the drum (as viewed in FIG. 1), there is a charge potential sensor 65 (an electrometer) which senses the voltage at the surface 55 and provides a continuous feedback signal to the charging power supply 67 to thereby adjust the charge level of the photoconductor surface 51 regardless of variations due, for example, to irregularities in the power supply or changes in the peripheral velocity of drum 50 which would alter the electrical characteristics of the drum.

Digital imaging device 54, in the form of relatively high intensity double row LED array 70 is mounted to extend transversely of the rotating drum surface 51. Each L.E.D. is individually driven from a corresponding driver amplified circuit, details of which need not be described herein. Light emitted from the L.E.D.s is in the range of 655–685 nm through a Selfoc lens 72 onto the drum surface 51 in a spot size of 0.0033 inch diameter. In one successful embodiment, there are a total of 6144 L.E.D.s in the array, divided between two rows which are spaced apart in a direction along the circumference of the surface by 0.010 inch and all fixed to a liquid cooled base block 74. The space between adjacent L.E.D.s in the same row is 0.0033 inch horizontally or transverse to the drum surface and the L.E.D. arrays in the two rows are offset horizontally by the same dimension, thus the L.E.D.s can cooperate to discharge a continuous series of dots across drum surface 51 at a resolution of 300 dots/inch.

Light from the L.E.D.s operates to discharge the background or non-image areas of the passing drum surface to a substantially lower potential, for example, in the order of +100 to +300 volts d.c. by exposing individual dot areas to radiation at a predetermined frequency, as mentioned, whereby the remaining or image areas comprise a latent electrostatic image of the printed portions of the form.

Although the use of an L.E.D. arrangement has been depicted herein as providing for the requisite image, other conventional means for forming the requisite image may also be utilized. For instance, laser printing and conventional exposure methods through transparencies and the like may also be utilized, although they are not preferred.

The latent electrostatic image then is carried, as the drum rotates, past developing station 55 where it is subjected to the action of a special high speed liquid toner developer of the type comprising a dielectric carrier liquid material, such as the Isopar series of hydrocarbon fractions, resinous binder particles, and color-imparting dye and/or pigment particles. As is known in the art, the desired charge may be chemically supplied to the resin-pigment/dye particles by utilization of well-known charge control agents such as lecithin and alkylated vinylpyrrolidone materials. In the embodiment shown, drum 50 comprises an $As_2$,$Se_3$ photoconductive layer to which charge coronas 52 impart a positive charge. The toner particles are accordingly provided with a negative charge in the range of about 60 to 75 picamhos/cm.

The developing station 55 comprises a shoe member 80, which also functions as a developer electrode (which is electrically insulated from drum 50 and extends transversely across drum surface 51). The face of shoe member 80 is curved to conform to a section of drum surface 51 and, in a successful embodiment, has a length, along the arcuate face, of about 7 inches, slightly less than ¼ of the circumference of drum surface 51, and which is closely fitted to the moving drum surface, for example, at a spacing of about 500 microns (0.020 inch). Shoe 80 is divided into first and second cavities 82, 83 through each of which is circulated liquid toner dispersion from a liquid toner dispersion supply and replenishment system.

The developer shoe 80 functions as an electrode which is maintained at a potential on the order of about +200 to 600 volts d.c. Thus, the negatively charged toner particles are introduced into the shoe cavities and dispersed among electrical fields between: 1) the image areas and the developer electrode on the one hand and between 2) the background and the developer electrode on the other hand. Typically, the electrical fields are the result of difference in potential: a) between the image areas (+1000 to 1450 volts) and the developer electrode (+200 to +600 volts) which causes the negatively charged toner particles to deposit on the image areas, and b) the field existing between the background areas (+100 to +300 volts) and the developer electrode (+200 to +600 volts) which later field causes the toner particles to migrate away from the background areas to the developer shoe. The result is a highly distinctive contrast potential between image and background areas, with good color coverage being provided in the solid image areas. The tendency of toner particles to build up on the developer shoe or electrode is overcome by the circulation of the liquid toner therethrough at rates in the order of about 7.57 to 37.85 liters/min. (2 to 10 gallon/min.) back to the toner refreshing system.

As the drum surface passes from the developer shoe, a reverse rotating metering roll 89, spaced parallel to and away from the drum surface by about 50–75 microns, acts to shear away any loosely attracted toner in the image areas, and also to reduce the amount of volatile carrier liquid carried by the drum. The metering role has applied to it a bias potential on the order of about +200 to +600 volts d.c. varied according to web velocity which scavenges any loose toner particles which might have migrated into the background areas.

Proceeding further in the counterclockwise direction with respect to FIG. 1, there is shown transfer apparatus 56 as including a pair of idler rollers 90*a, b* which guide web W onto the "3 o'clock" location of drum 50, and behind the web path at this location is a transfer coratron 92. The web is driven at a speed equal to the velocity of drum surface 51, to minimize smearing or distortion of the developed image on the surface 51. The positioning of rollers 90*a, b* is such that the width (top-bottom) of the transverse band 95 of web-drum surface contact is about from 0.1–1.0 inch, preferably 0.5 inch, centered on a radius of the drum which intersects the coratron wire 93, as shown by the dot-dash line in FIG. 1.

The shape of the transfer coratron shield 96, and the location of the axis of the tungsten wire 93 in shield 96, is such as to focus the ion "spray" 98 from the coratron onto the web-drum contact band on the reverse side of web W. The transfer coratron 92 has applied to it a voltage in the range of +6600 to +8000 v d.c., and the distance between the coratron wire 93 and the surface of web W is in the order of 0.10 to 0.20 inch. This results in a transfer efficiency of at least 95%. Both toner particles and liquid carrier transfer to the web, including carrier liquid on the drum surface 51 in the image and background areas.

Accordingly, by the imposition of an electrical voltage of about +6600 to +8000 v d.c. by the transfer coratron 92 onto the backside of travelling web W and since the charge on the image on cylinder 50 is about +1000 v, a powerful electrical field from the web W to the cylinder is created. The negatively charged solids toner particles are thereby strongly directed to migrate counter to this field and adhere to the web surface in the web-cylinder interface area. Preliminary results have indicated that the efficiency of the transfer system is about at least 95%. That is, 95% or greater of the solids toner particles travelling on cylinder 50 are transferred to the web. Carrier liquid is also transferred to the web at the web-cylinder interface primarily through surface contact and capillary action.

The fact that such rapid and efficient image transfer occurs is important due to the high accuracy requirements of the overall printing apparatus and system. As above noted, it is essential that the web W travel at a speed equal to the peripheral (surface) speed of cylinder 50 at the web-cylinder interface so as to reduce image smearing and distortion. This dictates that web W be driven synchronously with the peripheral speed of cylinder 50. This, in accordance with the high speed requirements of the press, requires web speeds of 100 ft./min. up to about 500 ft./min.

As is shown in FIG. 1, the cross-section shape of coratron shield 96 is substantially a reversed "C" section. This particular configuration, as well as others, focuses a narrow band of ions at the web cylinder interface. Although the use of idler rollers 90*a, b* has been depicted, and indeed is preferred, as functioning to present a portion of web W adjacent to and in contact with a portion of cylinder 50 at essentially the three o'clock position, other equivalent conveyor means can be used. Also, as shown, the idler rollers 90*a, b* are both located intermediate drum 50 and transfer corona 92. Other arrangements can be successfully employed so long as the web W in the area of surface contact with drum 50 is synchronously driven with respect to the peripheral speed of drum 50. After the requisite image has been transferred from cylinder 50 to web W, web W is conveyed through a heater-fuser station 300. Chill roll 206 provides drive for web W through gear box 212 and line shaft 200. As the web passes around chill roll 206, idler rolls 230, 232 guide it to downstream work stations.

Figure 2:
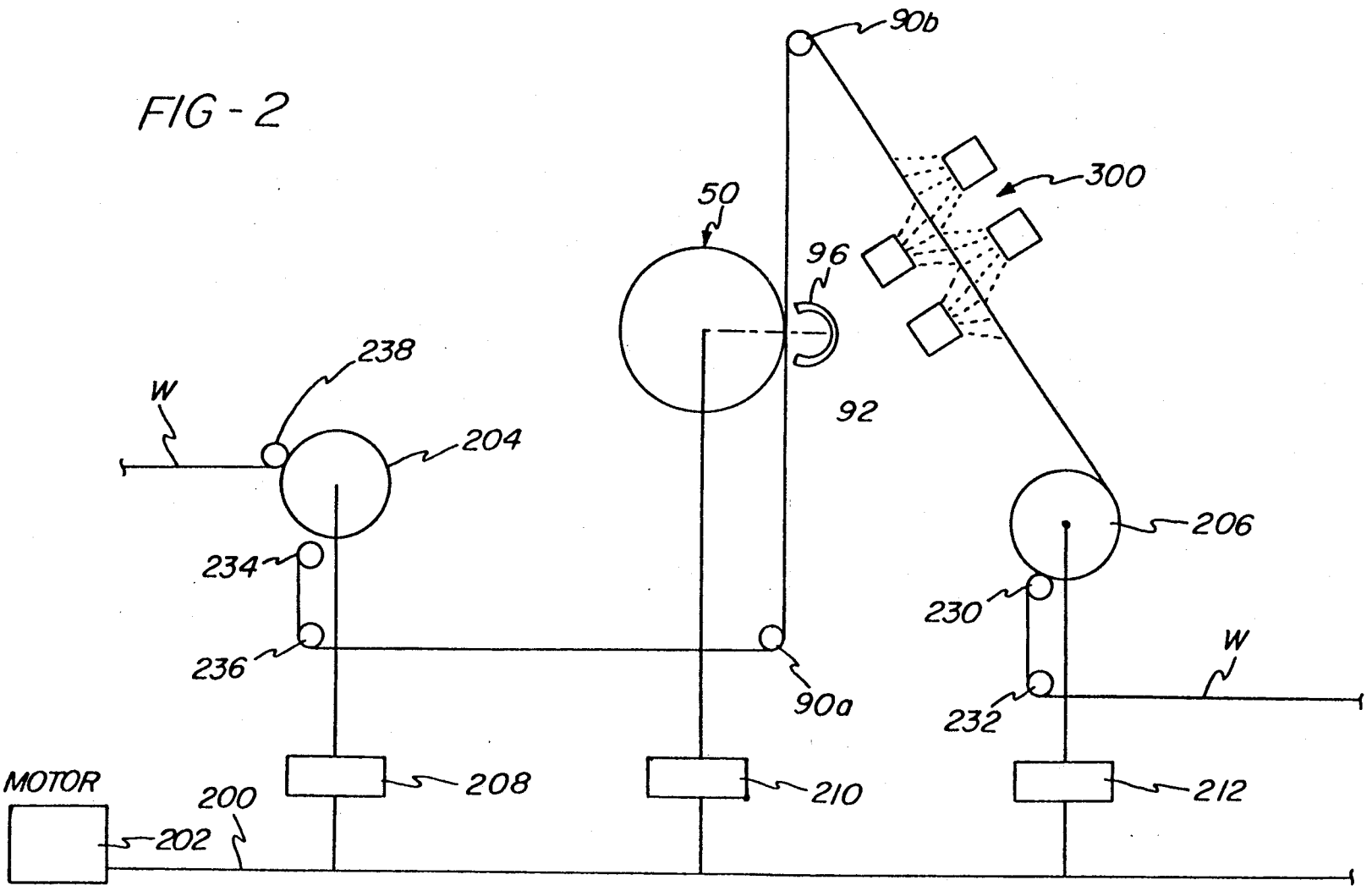
FIG. 2 is a schematic diagram showing the means for driving the web in synchronization with the peripheral speed of the printing cylinder.

Turning now to FIG. 2 of the drawings, a diagrammatic view of the drive means providing for synchronization of the web speed and the peripheral speed of print cylinder 50 at the web-cylinder interface is shown. Here, line shaft 200 connected to motor 202 provides drive for unwind roll 204, print cylinder 50 and chill roll 206 as explained hereafter. Gear boxes 208, 210, 212, shown schematically, provide for individual speed adjustment of unwind roll 204, print cylinder 50 and chill roll 206 respectively. Web W is pulled via action of unwind roll 204 and is guided via idler rollers 238, 234, and 236 to idler rolls 90*a* and 90*b* for presentation adjacent the surface of cylinder 50 at the transfer coratron 92 location.

As shown in FIG. 2, the speed of web W is controlled by variable speed chill roll 206 that is driven by line shaft 200 through gears 212. Chill roll 206 is internally cooled to help cool the web after the requisite image has been fused thereon in the fuser-dryer section 300 of the apparatus.

Figure 3:
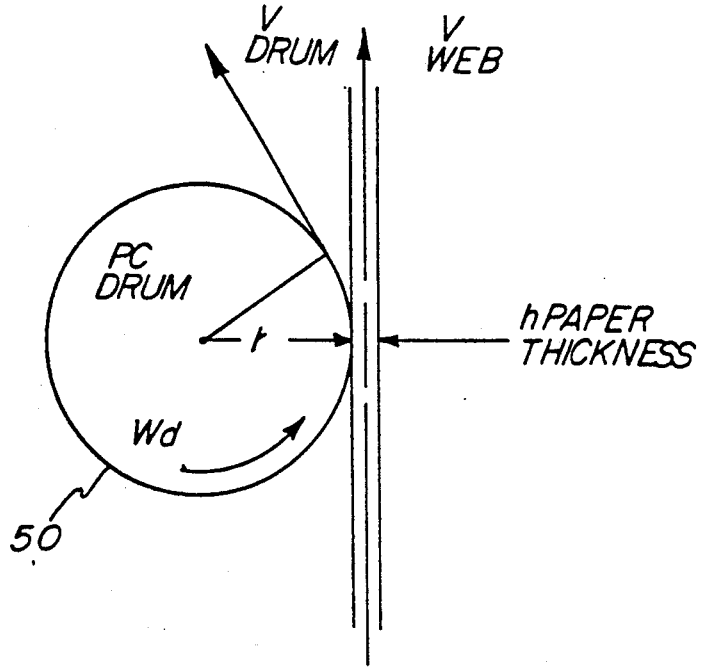
FIG. 3 is a schematic view of the print cylinder 50 at the web-cylinder interface.

The print cylinder 50 is also driven via line shaft 200 through gearing 210. As illustrated in FIG. 3, for a chosen radius r of cylinder 50, an angular velocity Wd for cylinder 50 is selected so as to provide a cylinder 50 surface speed V drum that closely approximates the web speed V web in the area of the print cylinder-web interface.

$$V\,\text{drum} = rWd$$

The speed of the web is controlled to Vd(±0.5%). The angular velocity of the drum 50 Wd is fixed by the gear ratio Gd between the drum 50 and the line shaft angular velocity Wo in accordance with $$Wd = GdWo$$

Figure 4:
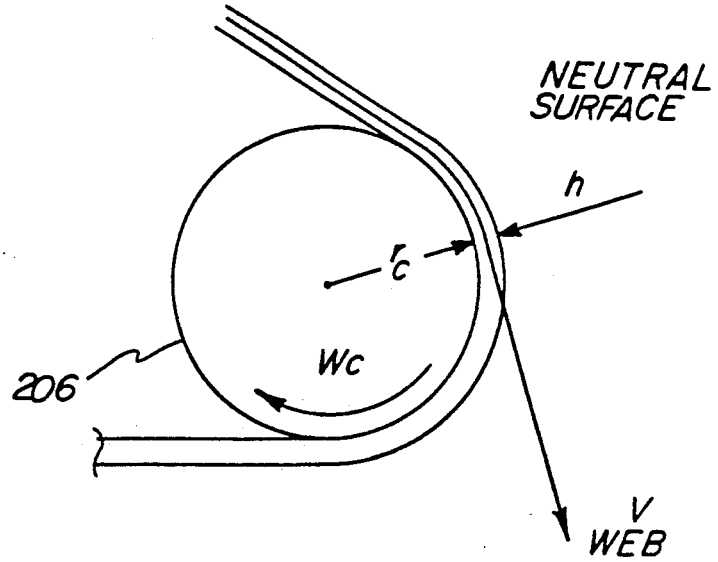
FIG. 4 is a schematic view of the chill roll used to drive the web w.

The velocity of the web is the velocity at the neutral surface proximate chill roll 206 at one half of the web thickness (see FIG. 4) in accord with $$V\,\text{web} = (r_c + h/2)GcWo$$
$$V\,\text{drum} = rGdWo$$

$$\frac{V\,\text{web}}{V\,\text{drum}} = \frac{(r_c + h/2)Gc}{Gd}$$

Gc is the gear ratio between chill roll 206 and the line shaft 200 angular velocity Wo. $r_c$, r, and $g_d$ are all constants. Gc is variable and h changes with the paper size. Accordingly, Gc is varied so as to synchronize the speed of web W to the surface speed of drum 50 in the area of the transfer corona 92. A variable speed of ±0.5% on the chill roll drive is used to match the web speed to the print cylinder drum speed.

Although this invention has been described with respect to certain preferred embodiments, it will be appreciated that a wide variety of equivalents may be substituted for those specific elements shown and described herein, all without departing from the spirit and scope of the invention as defined in the appended claims.

We claim:

1. In a high speed electrophotographic printing process of the type wherein a latent electrostatic image is formed on a rotating electrophotoconductive cylinder by charging said cylinder with a uniform electrical charge of a desired polarity and potential, followed by formation of a latent electrostatic image by exposing non-image areas to a lower potential than said uniform electrical charge, and wherein solids color-imparting toner particles having a polarity opposite of that of said uniform charge are dispersed in a liquid toner dispersion and are attracted to and electrostatically adhere to said image areas, a method for transferring said liquid toner dispersion from said cylinder to a continuously moving carrier web comprising:

rotating said electrophotoconductive cylinder at a peripheral speed of at least about 100 ft./min.;

guiding said continuously moving carrier web into direct contact with said rotating cylinder to form a cylinder surface - web interface;

focusing a band of charged ions on said web proximate said interface to transfer said toner particles from said cylinder to said carrier web, said ions being charged to a higher potential than said uniform charge whereby said toner particles are attracted to said web; and synchronizing the speed of said continuously moving carrier web with the peripheral speed of said electrophotoconductive cylinder to minimize smearing or distortion of said image.

2. Method as recited in claim 1 comprising transferring at least about 95% of said toner particles from said cylinder to said carrier web.

3. Method as recited in claim 2 wherein said interface area comprises about 0.1–1 inch in length.

4. Method as recited in claim 3 wherein said interface area comprises about 0.5 inch in length.

5. Method as recited in claim 4 wherein said ions are charged to a voltage of about 6600–8000 volts.

6. Method as recited in claim 1 wherein said focusing comprises deflecting said ions with a shield.

7. Method as recited in claim 1 wherein the potential of said uniform electric charge is about three times greater than said lower potential.

8. Method as recited in claim 1 wherein said ions have a potential of about 5000 or more volts greater than said uniform charge potential.

9. Method as recited in claim 1 wherein said focusing comprises focusing said band of charged ions onto a side of said web opposite from said interface area.

10. High speed electrophotoconductive printing apparatus of the type having a rotatable electrophotoconductive cylinder that is charged with a uniform electrical charge of a predetermined potential and polarity and wherein non-image areas of said cylinder are exposed to a lower potential to form a latent electrostatic image, wherein solids color-imparting toner particles having a polarity opposite from that of said uniform charge are dispersed in a liquid toner dispersion and are attracted to and electrostatically adhere to said image areas, a combination for transferring said liquid toner dispersion from said cylinder to a continuously moving carrier web comprising:

(a) means for guiding said continuously moving web into direct contact with said rotating cylinder to define a cylinder surface - carrier sheet interface;

(b) transfer charge means for focusing a band of charged ions proximate said interface to transfer at least about 95% of said solids color-imparting particles from said cylinder to said carrier web; said ions being charged to a higher potential than said uniform charge whereby said toner particles are attracted to said web; and (c) means for synchronizing the speed of said continuously moving web with the speed of said cylinder to minimize smearing or distortion of said image.

11. Apparatus as recited in claim 10 wherein said means (a) comprise conveyor means located adjacent said cylinder, said conveyor means carrying said carrier web.

12. Apparatus as recited in claim 10 wherein said conveyor means is located intermediate said cylinder and said transfer charge means (b), said transfer charge means comprising deflection means for deflecting said ions through said carrier web at said interface.

13. Apparatus as recited in claim 12 wherein said transfer charge means (b) comprises a tungsten charge wire disposed within said deflection means.

14. Apparatus as recited in claim 10 wherein said interface defines an area that is about 0.1–1 inch in length.

15. Apparatus as recited in claim 14 wherein said interface defines an area that is about 0.5 inch in length.

16. Apparatus as recited in claim 10 wherein said transfer charge means focuses said band of charged ions onto a side of said web opposite from said interface area.

* * * * *